US006463408B1

(12) United States Patent
Krasny et al.

(10) Patent No.: US 6,463,408 B1
(45) Date of Patent: Oct. 8, 2002

(54) SYSTEMS AND METHODS FOR IMPROVING POWER SPECTRAL ESTIMATION OF SPEECH SIGNALS

(75) Inventors: Leonid Krasny, Cary, NC (US); Soontorn Oraintara, Arlington, TX (US)

(73) Assignee: Ericsson, Inc., Research Triangle Park, NC (US)

( * ) Notice: Subject to any disclaimer, the term of this patent is extended or adjusted under 35 U.S.C. 154(b) by 104 days.

(21) Appl. No.: 09/717,333

(22) Filed: Nov. 22, 2000

(51) Int. Cl.[7] ..... G10L 21/02
(52) U.S. Cl. ..... 704/217; 704/233
(58) Field of Search ..... 704/217, 233, 704/226, 218, 228, 204, 205, 206, 207, 219

(56) References Cited

U.S. PATENT DOCUMENTS

| | | | | | |
|---|---|---|---|---|---|
| 4,630,304 | A | * | 12/1986 | Borth et al. | 381/94 |
| 5,706,395 | A | * | 1/1998 | Arslan et al. | 395/2.35 |
| 5,781,883 | A | * | 7/1998 | Wynn | 704/226 |
| 5,943,429 | A | * | 8/1999 | Handel | 381/94.2 |
| 6,014,620 | A | * | 1/2000 | Handel | 704/219 |
| 6,070,137 | A | | 5/2000 | Bloebaum et al. | 704/227 |
| 6,122,384 | A | * | 9/2000 | Mauro | 381/94.3 |
| 6,122,610 | A | | 9/2000 | Isabelle | 704/226 |
| 6,263,307 | B1 | * | 7/2001 | Arslan et al. | 704/226 |
| 6,324,502 | B1 | * | 11/2001 | Handel et al. | 704/226 |

FOREIGN PATENT DOCUMENTS

| | | |
|---|---|---|
| WO | WO 95/15550 | 6/1985 |
| WO | WO 96/24128 | 8/1996 |
| WO | WO 97/28527 | 8/1997 |
| WO | WO 99/01942 | 1/1999 |
| WO | WO 99/62054 | 12/1999 |

OTHER PUBLICATIONS

ICASSP–89. International Conference on Acoustics, Speech, and Signal Processin, 1989. Morgera et al., "Structured maximum likelihood autoregressive parameter estimation" PP 2202–2205 vol. 4, May 1989.*

ICASSP–93., 1993 IEEE International Conference on Acosutics, Speech, and Signal Preocessing, 1993. Giovannelli et al., "A statistical study of a regularized method for long auto–regressive estimation" PP 137–140 vol. 4. Apr. 1993.*

"Suppression of Acoustic Noise in Speech Using Spectral Subtraction"; Steven F. Boll; IEEE Transactions on Acoustics, Speech, and Signal Processing, vol. ASSP–27, No. 2, Apr. 6, 1979; pp. 113–120.

* cited by examiner

*Primary Examiner*—Richemond Dorvil
(74) *Attorney, Agent, or Firm*—Harrity & Synder, L.L.P.

(57) ABSTRACT

A system determines a power spectral density associated with an audio signal that includes a speech signal and/or a noise signal. The system updates an autocorrelation function of the audio signal from samples in the audio signal, estimates an autocorrelation function of the speech signal from the updated autocorrelation function of the audio signal, and calculates a power spectral density of the speech signal using the estimated autocorrelation function. The system then determines the power spectral density of the audio signal from the calculated power spectral density of the speech signal.

31 Claims, 4 Drawing Sheets

SYSTEMS AND METHODS FOR IMPROVING POWER SPECTRAL ESTIMATION OF SPEECH SIGNALS

BACKGROUND OF THE INVENTION

The present invention relates generally to radio communications and, more particularly, to systems and methods that reduce background noise associated with speech signals.

Over the past decade, the use of mobile terminals has increased dramatically. So too have the features associated with these devices. Presently, mobile terminals may be used to place and receive telephone calls, connect to the Internet, send and receive pages and facsimiles, etc. from almost any location in the world. As the demand for these devices increases, designers of mobile terminals are continually seeking new ways to improve performance.

BRIEF SUMMARY OF THE INVENTION

Systems and methods, consistent with the present invention, estimate power spectral densities of speech signals used for reducing noise. The systems and methods allow the speech signals' power spectral density to be approximated in even low signal-to-noise situations, resulting in improved noise reduction.

In accordance with the invention as embodied and broadly described herein, a method for determining a power spectral density associated with an audio signal that includes a speech signal and/or a noise signal comprises updating an autocorrelation function of the audio signal from samples in the audio signal; estimating an autocorrelation function of the speech signal from the updated autocorrelation function of the audio signal; calculating a power spectral density of the speech signal using the estimated autocorrelation function; and determining the power spectral density of the audio signal from the calculated power spectral density of the speech signal.

In another implementation consistent with the present invention, a noise reduction system comprises a converter, a power spectral estimator, and a filter. The converter receives an audio signal and divides the audio signal into multiple frames. Each of the frames comprises a mixed signal containing a speech signal and/or a noise signal. The power spectral estimator determines a power spectral density associated with the mixed signal for each of the frames by updating an autocorrelation function of the mixed signal from samples in the frame, estimating an autocorrelation function of the speech signal in the frame from the updated autocorrelation function, determining a power spectral density of the speech signal using the estimated autocorrelation function, and determining a power spectral density of the mixed signal using the determined power spectral density of the speech signal. The filter performs spectral subtraction on the frames using the determined power spectral densities associated with the mixed signals of the frames to reduce noise associated with the audio signal.

In a further implementation consistent with the present invention, a computer-readable medium stores instructions executable by one or more processors to perform a method for reducing noise associated with an audio signal. The audio signal comprises a speech signal and/or a noise signal. The computer-readable medium comprises instructions for updating an autocorrelation function of the audio signal from samples in the audio signal; instructions for determining an autocorrelation function of the speech signal from the updated autocorrelation function of the audio signal; instructions for determining a power spectral density of the speech signal using the estimated autocorrelation function; instructions for determining the power spectral density of the audio signal from the calculated power spectral density of the speech signal; and instructions for using the power spectral density of the audio signal to reduce noise associated with the audio signal.

BRIEF DESCRIPTION OF THE DRAWINGS

The accompanying drawings, which are incorporated in and constitute a part of this specification, illustrate the invention and, together with the description, explain the invention. In the drawings.

DETAILED DESCRIPTION OF THE INVENTION

The following detailed description of the invention refers to the accompanying drawings. The same reference numbers in different drawings identify the same or similar elements. Also, the following detailed description does not limit the invention. Instead, the scope of the invention is defined by the appended claims and equivalents.

Systems and methods, consistent with the present invention, provide improved power spectral estimation of speech signals for noise reduction. The systems and methods provide particular benefits during frames containing both speech and noise signals.

Figure 1:
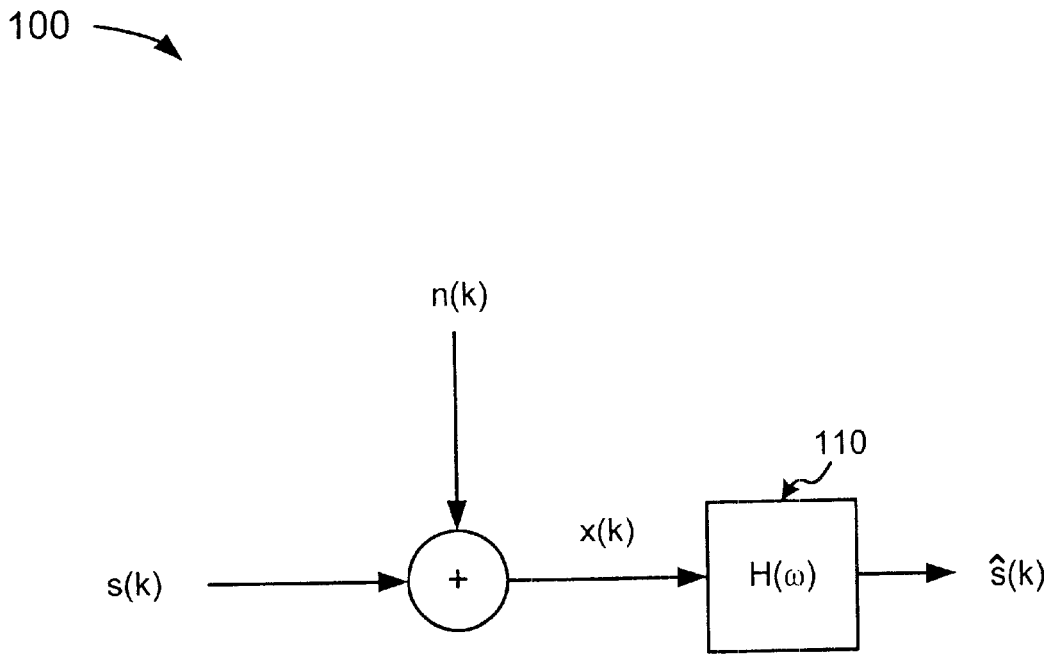
FIG. 1 is a diagram of a speech reduction model upon which systems and methods consistent with the present invention may operate.

FIG. 1 is a diagram of a speech reduction model 100 upon which systems and methods consistent with the present invention may operate. The model 100 shows a speech signal s(k) that is degraded by an additive independent noise n(k), resulting in a mixed audio signal x(k) The model may be represented by:

$$x(k)=s(k)+n(k), \tag{1}$$

where k=1, . . . , N. N denotes the number of samples in a frame of speech. The speech signal is assumed stationary over the frame, while the noise signal is assumed stationary over several frames. Further, it is assumed that the speech activity is sufficiently low, so that a model of the noise can be accurately estimated during non-speech activity.

The mixed audio signal x(k) may be input to a noise suppression system 110 to reduce the noise level in the mixed audio signal x(k). The noise suppression system 110 may include a spectral subtraction system that outputs a noise-reduced speech signal $\hat{s}(k)$.

Figure 2:
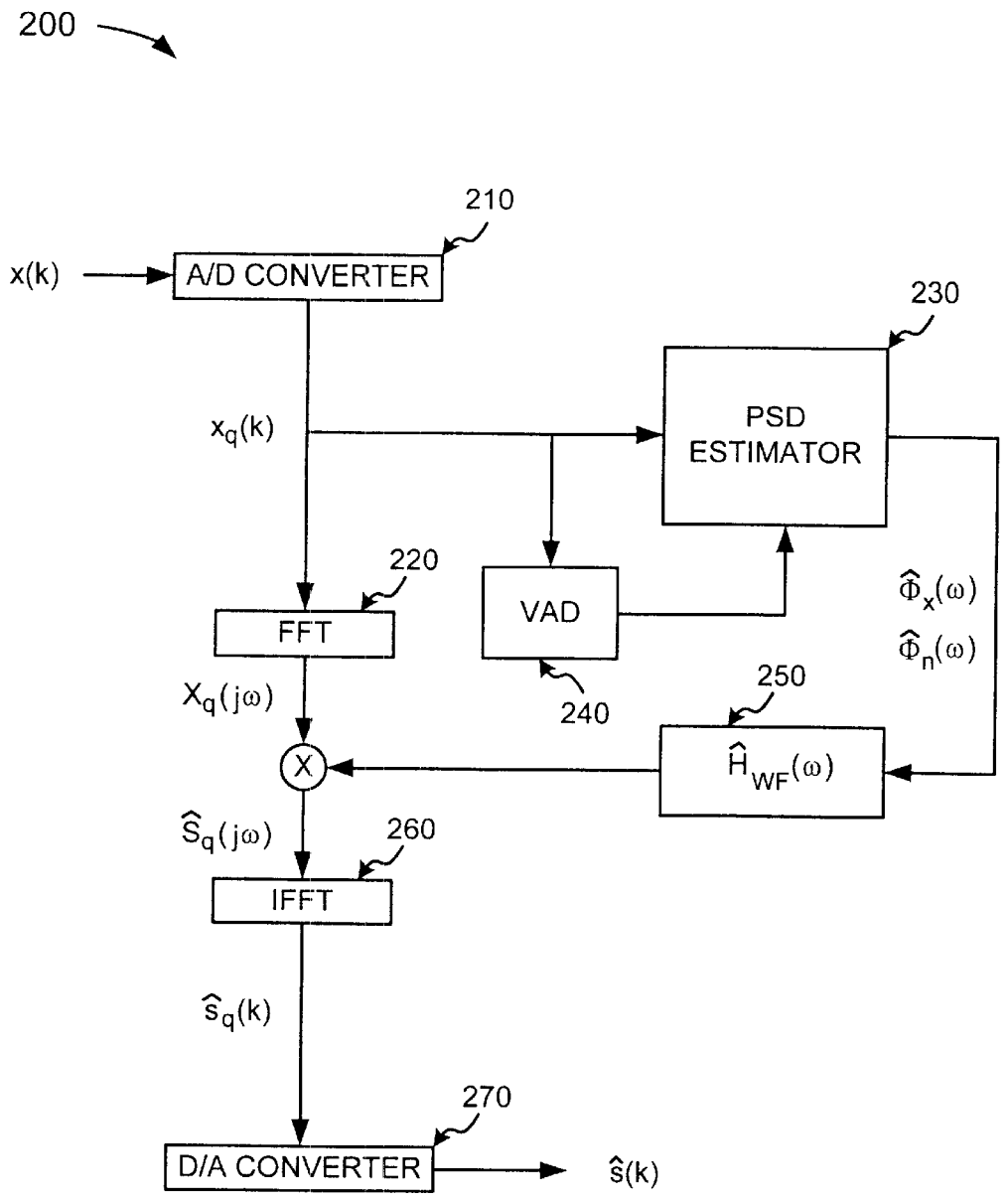
FIG. 2 is an exemplary diagram of a spectral subtraction noise suppression system consistent with the present invention.

FIG. 2 is an exemplary diagram of a spectral subtraction noise suppression system 200 consistent with the present invention. The system 200 may, for example, be incorporated within a mobile terminal. As used herein, the term "mobile terminal" may include a cellular radiotelephone with or without a multi-line display; a Personal Communications System (PCS) terminal that may combine a cellular radiotelephone with data processing, facsimile, and data communications capabilities; a personal digital assistant (PDA) that can include a radiotelephone, pager, Internet/intranet access, Web browser, organizer, calendar, and/or a global positioning system (GPS) receiver; and a conventional laptop and/or palmtop receiver or other appliance that includes a radiotelephone transceiver. Mobile terminals may also be referred to as "pervasive computing" devices.

The system 200 may be implemented in hardware, such as a combination of logic, and/or software, including firmware, resident software, micro-code, etc. Furthermore, the system 200 may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared or semiconductor system, apparatus, device, or propagation medium. More specific examples (a non-exhaustive list) of the computer-readable medium might include the following: an electrical connection having one or more wires, a portable computer diskette, a random access memory (RAM), a read-only, memory (ROM), an erasable programmable read-only memory (EPROM or Flash memory), an optical fiber, and a portable compact disc read-only memory (CD-ROM). The computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

As shown in FIG. 2, the system 200 may include a combination of hardware and/or software components, such as a serial-to-parallel (S/P) converter 210, a transformation block 220, a power spectral density (PSD) estimator 230, a voice activity detector (VAD) 240, a filter 250, a multiplier 260, an inverse transformation block 270, and a parallel-to-serial (P/S) converter 280.

The S/P converter 210 may include a mechanism that receives an audio signal, such as the mixed signal x(k), from a source, such as a microphone (not shown), and divides the received signal into a number of frames (or blocks) $x_1$, $x_2$, . . . $X_D$, where D is the total number of frames. Each of the frames may be a vector with length L. The description that follows will describe a particular frame, $X_q=(x((q-1)L), x((q-1)L+1, \ldots, x((q-1)L+L-1))^T$, where $1<q<D$. It should be understood that the system 200 may perform similar processing for other frames of the received signal. Once the S/P converter 210 divides the audio signal x(k) into frames, the audio signal x(k) may then be processed frame-by-frame. Adjacent frames may have some overlapping in order to reduce the discontinuity between them.

The transformation block 220 may include Fast Fourier Transform (FFT) logic that operates upon the frame $x_q(k)$ to transform the frame into its corresponding frequency-domain signal, $X_q(j\omega)$. In an implementation consistent with the present invention, the transformation block 220 includes L-point FFT logic. The PSD estimator 230 may include logic that estimates the PSD of the speech signal $\hat{\Phi}_s(\omega)$, the noise signal $\hat{\Phi}_n(\omega)$, and/or the mixed signal $\hat{\Phi}_x(\omega)$. The functions performed by the PSD estimator 230 will be described in more detail below.

The VAD 240 may include mechanisms to determine whether the frame $x_q(k)$ contains speech or background noise. The VAD 240 may be implemented as a state machine that outputs a control signal to the PSD estimator 230 based on its determination. The filter 250 may include logic that performs spectral subtraction. The actual form of the filter 250 may depend upon one or more of the estimates, $\hat{\Phi}_s(\omega)$, $\hat{\Phi}_x(\omega)$, and $\hat{\Phi}_n(\omega)$, generated by the PSD estimator 230. In an implementation consistent with the present invention, the filter 250 is a spectral subtraction Wiener filter:

$$\hat{H}_{WF}(\omega) = 1 - \frac{\hat{\Phi}_n(\omega)}{\hat{\Phi}_x(\omega)}. \tag{2}$$

The multiplier 260 may include multiplication logic to multiply the signal $X_q(j\omega)$ by the filter signal $\hat{H}_{WF}(\omega)$ to produce a resulting signal $\hat{S}_q(j\omega)$. The inverse transformation block 270 may include Inverse Fast Fourier Transform (IFFT) logic that operates upon the signal $\hat{S}_q(j\omega)$ from the multiplier 260 to transform the signal into its corresponding time-domain signal $\hat{s}_q(k)$. In an implementation consistent with the present invention, the inverse transformation block 270 includes L-point IFFT logic.

The P/S converter 280 include a mechanism that combines the processed frames and outputs a noise-reduced speech signal $\hat{s}(k)$. The P/S converter 280 may send the speech signal $\hat{s}(k)$ to a speech encoder (not shown) that generates a bit stream for transmission over a network.

Figure 3:
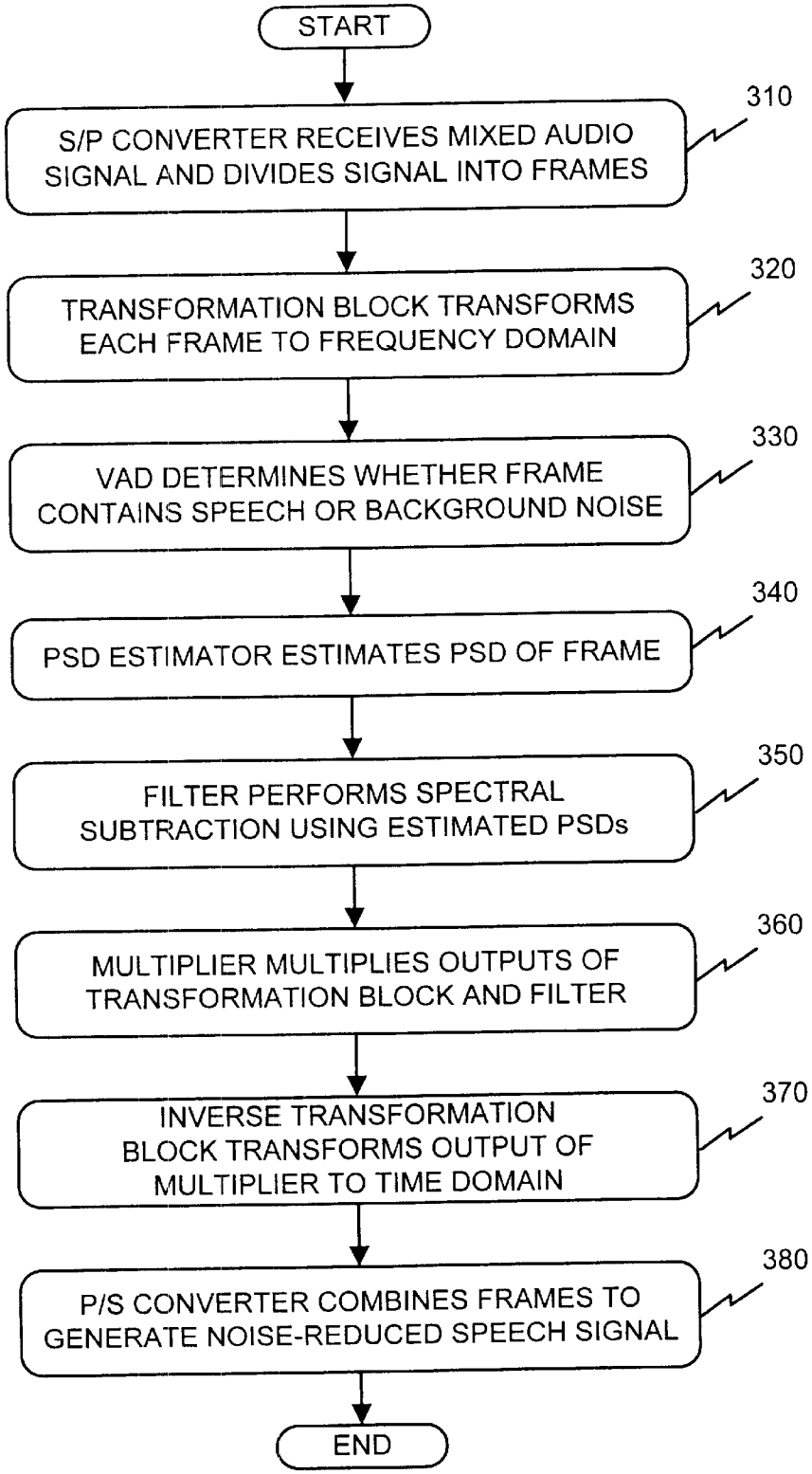
FIG. 3 is a flowchart of exemplary processing by the spectral subtraction noise suppression system of FIG. 2 according to an implementation consistent with the present invention.

FIG. 3 is a flowchart of exemplary processing by the spectral subtraction noise suppression system 200 according to an implementation consistent with the present invention. Processing may begin with the S/P converter 210 receiving a mixed audio signal, such as mixed signal x(k), from a source [act 310]. The source may include a microphone that captures a mixed audio signal that combines a speech signal s(k) and background noise n(k) associated with a conversation. The microphone may convert the audio signal from analog to digital form and transmit the signal to the S/P converter 210. The S/P converter 210 may divide the received signal into a number of frames, each of which may be a vector of length L [act 310].

The S/P converter 210 may then forward each of the frames for processing. The following discussion will relate to one particular frame, $x_q(k)$, in the received mixed audio signal x(k). It is to be understood that similar processing may occur for other ones of the frames.

The transformation block 220 may transform the frame $x_q(k)$ to the frequency domain to obtain its frequency representation $X_q(j\omega)$ [act 320]. The transformation block 220 may use an L-point FFT to obtain the frequency representation $X_q(j\omega)$. The VAD 240 may also operate upon the frame $x_q(k)$. The VAD 240 may analyze the frame $x_q(k)$ to determine whether the frame contains speech or background noise [act 330]. The VAD 240 may generate a control signal based on its determination and send the control signal to the PSD estimator 230. The PSD estimator 230 may estimate the PSD of the frame $x_q(k)$ [act 340]. In an implementation consistent with the present invention, the PSD estimator 230 determines the PSDs of the noise signal and the mixed signal (i.e., $\hat{\Phi}_n(\omega)$ and $\hat{\Phi}_x(\omega)$).

Figure 4:
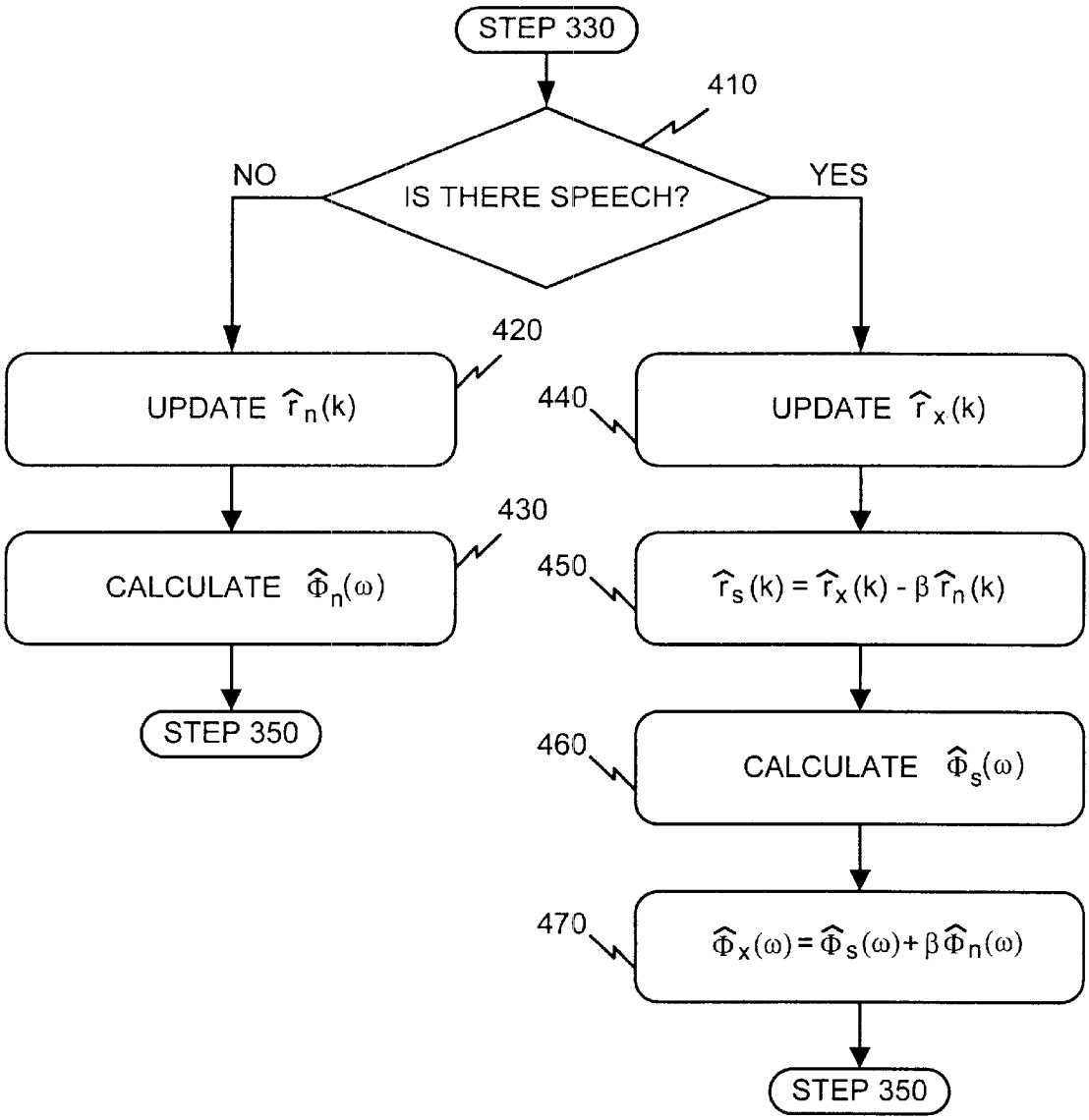
FIG. 4 is a flowchart of exemplary processing by the power spectral density estimator of FIG. 2 according to an implementation consistent with the present invention.

FIG. 4 is a flowchart of exemplary processing by the PSD estimator 230 according to an implementation consistent with the present invention. The PSD estimator 230 operates upon the assumption that the speech signal s(k) and the noise signal n(k) are independent. Therefore, the relation among the autocorrelation functions of s(k), n(k), and x(k)=s(k)+n (k) can be given by:

$$r_x(k)=r_s(k)+r_n(k). \tag{3}$$

The PSD estimator 230 may determine whether the frame $x_q(k)$ contains speech or background noise [step 410]. The PSD estimator 230 may make this determination using the control signal from the VAD 240. If the frame $x_q(k)$ contains only background noise, then x(k)=n(k). In this case, the PSD estimator 230 may update the autocorrelation function $\hat{r}_n(k)$ in a conventional manner from samples in the current frame [act 420].

The PSD estimator 230 may then calculate the PSD of the noise signal n(k) (i.e., $\hat{\Phi}_n(\omega)$) [act 430]. The PSD of the noise signal $\hat{\Phi}_n(\omega)$ may be calculated in a conventional manner using, for example, periodogram analysis or an autoregressive (AR) model. During this frame, the PSD of the mixed signal x(k) (i.e., $\hat{\Phi}_x(\omega)$) remains the same as the previous frame.

When the frame $x_q(k)$ contains speech, then x(k)=s(k)+n (k). During this frame, the PSD of the noise signal $\hat{\Phi}_n(\omega)$ will not be updated and remains the same as the previous frame. The PSD estimator 230 may update the autocorrelation function $\hat{r}_x(k)$ from the samples in the current frame [act 440]. The PSD estimator 230 may then estimate the autocorrelation function of the speech signal $\hat{r}_s(k)$ from the difference between the autocorrelation function $\hat{r}_x(k)$ and the most recent estimate of $\hat{r}_n(k)$ [act 450]. This estimation may take the form:

$$\hat{r}_s(k)=\hat{r}_x(k)-\beta\cdot\hat{r}_n(k), \tag{4}$$

where $\beta\epsilon[0,1]$.

Having estimated the autocorrelation function $\hat{r}_s(k)$, the PSD 230 may estimate the AR parameter of the speech signal s(k) by using the Yule-Walker AR method and solving the equation:

$$\hat{r}_s(k)+\sum_{i=1}^{p}\hat{a}_{si}\hat{r}_s(k-i)=\begin{cases}|\hat{b}_s|^2, & k=0\\ 0, & k>0,\end{cases} \tag{5}$$

where $\hat{a}_s$ and $\hat{b}_s$ are variables. The PSD 230 may then calculate the PSD of the speech signal $\hat{\Phi}_s(\omega)$ using Levinson-Durbin recursion:

$$\hat{\Phi}_s(\omega)=\left|\frac{\hat{b}_s}{1+\sum_{l=1}^{p}\hat{a}_{sl}e^{-j\omega l\Delta t}}\right|^2 \tag{6}$$

[act 460].

The PSD estimator 230 may estimate the PSD of the mixed signal x(k) (i.e., $\hat{\Phi}_x(\omega)$) [act 470]. To estimate $\hat{\Phi}_x(\omega)$, the PSD estimator 230 may use the equation:

$$\hat{\Phi}_x(\omega)=\hat{\Phi}_s(\omega))+\beta\cdot\hat{\Phi}_n(\omega) \tag{7}$$

Returning to FIG. 3, the filter 250 may perform spectral subtraction using the estimated PSDs $\hat{\Phi}_x(\omega)$ and $\hat{\Phi}_n(\omega)$) from the PSD estimator 230 [act 350]. The filter 250 may perform spectral subtraction using the Wiener filter shown in equation 2 to generate a filter signal $\hat{H}_{WF}(\omega)$. The multiplier 260 may multiply the signal $X_q(j\omega)$ from the transformation block 220 by the filter signal $\hat{H}_{WF}(\omega)$ to produce a resulting signal $\hat{S}_q(j\omega)$ [act 360].

The inverse transformation block 270 may transform the signal $\hat{S}_q(j\omega)$ into its corresponding time-domain signal $\hat{s}_q(k)$ using, for example, L-point IFFT logic [act 370]. The P/S converter 280 may then combine the processed frames to generate noise-reduced speech signal ŝ(k) [act 380]. The P/S converter 280 may send the speech signal ŝ(k) to a speech encoder for subsequent transmission over a network.

The foregoing description of preferred embodiments of the present invention provides illustration and description, but is not intended to be exhaustive or to limit the invention to the precise form disclosed. Modifications and variations are possible in light of the above teachings or may be acquired from practice of the invention. For example, the described implementation includes software and hardware, but elements of the present invention may be implemented as a combination of hardware and software, in software alone, or in hardware alone. Also, while series of acts have been described with regard to FIGS. 3 and 4, the order of the acts may be varied in other implementations consistent with the present invention. No element, act, or instruction used in the description of the present application should be construed as critical or essential to the invention unless explicitly described as such.

The scope of the invention is defined by the claims and their equivalents.

What is claimed is:

1. A method for determining a power spectral density associated with an audio signal comprising at least one of a speech signal and a noise signal, comprising:

updating an autocorrelation function of the audio signal from samples in the audio signal;

estimating an autocorrelation function of the speech signal from the updated autocorrelation function of the audio signal;

calculating a power spectral density of the speech signal using the estimated autocorrelation function; and determining the power spectral density of the audio signal from the calculated power spectral density of the speech signal.

2. The method of claim 1, further comprising:

determining a power spectral density of the noise signal.

3. The method of claim 2, wherein the determining a power spectral density of the noise signal comprises:

using a power spectral density of a previous noise signal as the power spectral density of the noise signal.

4. The method of claim 2, wherein the determining the power spectral density of the audio signal using the calculated power spectral density of the speech signal comprises:

calculating the power spectral density of the audio signal from the calculated power spectral density of the speech signal and the determined power spectral density of the noise signal.

5. The method of claim 1, further comprising:

determining whether the audio signal contains speech.

6. The method of claim 5, further comprising:

calculating a power spectral density of the noise signal when the audio signal contains no speech.

7. The method of claim 6, wherein the calculating a power spectral density of the noise signal when the audio signal contains no speech comprises:

determining the power spectral density of the noise signal using one of a periodogram analysis and an autoregressive model.

8. The method of claim 1, further comprising:

estimating an autoregressive parameter of the speech signal using the estimated autocorrelation function.

9. The method of claim 8, wherein the estimating an autoregressive parameter of the speech signal using the estimated autocorrelation function comprises:

determining the autoregressive parameter of the speech signal using the Yule-Walker autoregressive method.

10. The method of claim 8, wherein the calculating a power spectral density of the speech signal using the estimated autocorrelation function comprises:

determining the power spectral density of the speech signal from the estimated autoregressive parameter of the speech signal.

11. The method of claim 1, wherein the estimating an autocorrelation function of the speech signal from the updated autocorrelation function of the audio signal comprises:

determining the autocorrelation function of the speech signal from a difference between the updated autocorrelation function and an estimate of an autocorrelation function of the noise signal.

12. The method of claim 1, wherein the calculating a power spectral density of the speech signal using the estimated autocorrelation function comprises:

determining the power spectral density of the speech signal using Levinson-Durbin recursion.

13. A noise reduction system, comprising:

a converter that receives an audio signal and divides the audio signal into a plurality of frames, each of the frames comprising a mixed signal containing at least one of a speech signal and a noise signal;

a power spectral estimator that determines a power spectral density associated with the mixed signal for each of the frames by updating an autocorrelation function of the mixed signal from samples in the frame, estimating an autocorrelation function of the speech signal in the frame from the updated autocorrelation function, determining a power spectral density of the speech signal using the estimated autocorrelation function, and determining a power spectral density of the mixed signal using the determined power spectral density of the speech signal; and a filter that performs spectral subtraction on the frames using the determined power spectral densities associated with the mixed signals of the frames to reduce noise associated with the audio signal.

14. The system of claim 13, wherein the power spectral estimator further determines a power spectral density of the noise signal.

15. The system of claim 14, wherein when determining a power spectral density of the noise signal, the power spectral estimator uses a power spectral density of the noise signal from a previous frame as the power spectral density of the noise signal.

16. The system of claim 14, wherein when determining the power spectral density of the mixed signal, the power spectral estimator uses the determined power spectral density of the speech signal and the determined power spectral density of the noise signal.

17. The system of claim 13, wherein the power spectral estimator further determines whether the mixed signal contains the speech signal.

18. The system of claim 17, wherein the power spectral estimator further calculates a power spectral density of the noise signal when the mixed signal contains no speech signal.

19. The system of claim 18, wherein when calculating a power spectral density of the noise signal, the power spectral estimator uses one of a periodogram analysis and an autoregressive model.

20. The system of claim 13, wherein the power spectral estimator further estimates an autoregressive parameter of the speech signal using the estimated autocorrelation function.

21. The system of claim 20, wherein when estimating an autoregressive parameter of the speech signal, the power spectral estimator uses the Yule-Walker autoregressive method.

22. The system of claim 20, wherein when determining a power spectral density of the speech signal, the power spectral estimator uses the estimated autoregressive parameter of the speech signal.

23. The system of claim 13, wherein when estimating an autocorrelation function of the speech signal, the power spectral estimator uses a difference between the updated autocorrelation function and an estimate of an autocorrelation function of the noise signal.

24. The system of claim 13, wherein when determining a power spectral density of the speech signal, the power spectral estimator uses Levinson-Durbin recursion.

25. The system of claim 13, wherein the filter comprises a Wiener filter.

26. The system of claim 13, further comprising:

a transformation block that transforms the audio signal into a corresponding frequency-domain signal;

a multiplier that multiplies the frequency-domain signal and an output of the filter; and an inverse-transformation block that transforms an output of the multiplier into a corresponding time-domain signal.

27. The system of claim 26, further comprising:

another converter that combines the time-domain signal associated with each of the frames to generate a noise-reduced speech signal.

28. A computer-readable medium that stores instructions executable by one or more processors to perform a method for reducing noise associated with an audio signal, the audio signal comprising at least one of a speech signal and a noise signal, the computer-readable medium comprising:

instructions for updating an autocorrelation function of the audio signal from samples in the audio signal;

instructions for determining an autocorrelation function of the speech signal from the updated autocorrelation function of the audio signal;

instructions for determining a power spectral density of the speech signal using the estimated autocorrelation function;

instructions for determining the power spectral density of the audio signal from the calculated power spectral density of the speech signal; and instructions for using the power spectral density of the audio signal to reduce noise associated with the audio signal.

29. The computer-readable medium of claim 28, wherein the instructions for determining an autocorrelation function of the speech signal from the updated autocorrelation function of the audio signal comprises:

instructions for using a difference between the updated autocorrelation function and an estimate of an autocorrelation function of the noise signal to determine the autocorrelation function of the speech signal.

30. The computer-readable medium of claim 28, wherein the instructions for determining a power spectral density of the speech signal using the estimated autocorrelation function comprises:

instructions for using Levinson-Durbin recursion to determine the power spectral density of the speech signal.

31. The computer-readable medium of claim 28, wherein the instructions for using the power spectral density of the audio signal to reduce noise associated with the audio signal comprises:

instructions for performing spectral subtraction using the power spectral density of the audio signal.

* * * * *